US008550466B2

(12) United States Patent
Priebe et al.

(10) Patent No.: US 8,550,466 B2
(45) Date of Patent: Oct. 8, 2013

(54) BULLET DECELERATING MEDIUM AND BULLET TRAPPING SYSTEM AND METHOD USING THE MEDIUM

(76) Inventors: Brian Paul Priebe, Olmsted Township, OH (US); Gary R. Mol, Marblehead, OH (US)

( * ) Notice: Subject to any disclaimer, the term of this patent is extended or adjusted under 35 U.S.C. 154(b) by 232 days.

(21) Appl. No.: 12/855,781

(22) Filed: Aug. 13, 2010

(65) Prior Publication Data

US 2012/0038110 A1 Feb. 16, 2012

(51) Int. Cl.
*F41J 13/00* (2009.01)

(52) U.S. Cl.
USPC ..... 273/410

(58) Field of Classification Search
USPC ..... 273/403–410
See application file for complete search history.

(56) References Cited

U.S. PATENT DOCUMENTS

| | | | | | |
|---|---|---|---|---|---|
| 570,820 | A | * | 11/1896 | Scratton | 273/404 |
| 4,201,385 | A | * | 5/1980 | Szabados | 273/410 |
| 4,445,693 | A | * | 5/1984 | Angwin | 273/404 |
| 4,819,946 | A | | 4/1989 | Kahler | |
| 4,846,043 | A | * | 7/1989 | Langsam | 89/1.1 |
| 4,856,791 | A | * | 8/1989 | McQuade | 273/410 |
| 5,618,044 | A | | 4/1997 | Bateman | |
| 5,848,794 | A | | 12/1998 | Wojcinski | |
| 5,988,647 | A | * | 11/1999 | Porter et al. | 273/410 |
| 6,016,735 | A | * | 1/2000 | Langner | 273/410 |
| 6,293,552 | B1 | * | 9/2001 | Wojcinski et al. | 273/410 |
| 6,378,870 | B1 | | 4/2002 | Sovine | |
| 7,334,617 | B2 | * | 2/2008 | Hill et al. | 152/47 |
| 7,416,002 | B2 | * | 8/2008 | Yu et al. | 152/197 |
| 7,571,912 | B2 | | 8/2009 | Larson | |
| 2005/0093243 | A1 | * | 5/2005 | Larson et al. | 273/410 |
| 2011/0037227 | A1 | * | 2/2011 | O'Neal et al. | 273/410 |
| 2011/0062667 | A1 | * | 3/2011 | Medina et al. | 273/404 |
| 2011/0233869 | A1 | * | 9/2011 | John et al. | 273/410 |
| 2011/0233870 | A1 | * | 9/2011 | Oh et al. | 273/410 |

* cited by examiner

*Primary Examiner* — Mark Graham
(74) *Attorney, Agent, or Firm* — Tucker Ellis LLP

(57) ABSTRACT

A bullet trap apparatus is provided for capturing an associated bullet traveling along a substantially linear trajectory. The bullet trap apparatus includes a support frame and a flowable material disposed on an upper surface of the support frame. The support frame has an upper surface configured to support associated material. The flowable material is disposed on the upper surface of the support frame substantially on the linear trajectory, and includes a plurality of sheets of substantially rectangular material. Each of the sheets are configured for deflecting the associated bullet from its substantially linear path and absorbing energy from the associated bullet by the deflecting, thereby slowing the traveling of the associated bullet through the flowable material. The flowable material includes a plurality of sheets of substantially rectangular material, each of the sheets including a rubber material and one or more sheets of a fabric material formed of woven strands coupled with the rubber material.

16 Claims, 8 Drawing Sheets

BULLET DECELERATING MEDIUM AND BULLET TRAPPING SYSTEM AND METHOD USING THE MEDIUM

BACKGROUND

The embodiments of the present application relate to the art of decelerating projectiles and, more particularly, to medium, apparatus holding the medium, and methods of decelerating bullets such as, for example in connection with firearm shooting ranges.

In the past, bullet trapping systems were bulky and hard to set up in the field. Many were not portable and therefore could not be easily moved from location to location as may be desired.

Some bullet trap systems use rubber grains and rubber nuggets. However, these types of medium have some disadvantages in their ability to efficiently capture a bullet therein and, further, they experience some severe degradation during extended use.

It is therefore desirable to have a portable bullet trap system and a flowable bullet trap medium therefor which efficiently captures projectiles such as bullets and which can efficiently capture the projectiles such as bullets for extended periods of use without the need to frequently replace the medium.

SUMMARY

A bullet trap apparatus is provided for capturing an associated bullet traveling along a substantially linear trajectory. The bullet trap apparatus includes a support frame and a flowable material disposed on an upper surface of the support frame. The support frame has an upper surface configured to support associated material. The flowable material is disposed on the upper surface of the support frame substantially on the linear trajectory, and includes a plurality of sheets of substantially rectangular material. Each of the sheets are configured for deflecting the associated bullet from its substantially linear path and absorbing energy from the associated bullet by the deflecting, thereby slowing the traveling of the associated bullet through the flowable material. Each of the sheets are also configured to be pierced by the traveling bullet, thereby also slowing the bullet as it travels through the flowable medium. In these ways, bullets are brought to a rest for containment within the apparatus.

In addition, an energy absorbing medium is provided for use as a backstop, in a pile or in a bullet trap apparatus for capturing an associated bullet traveling along a substantially linear trajectory, the bullet trap apparatus including a support frame having an upper surface configured to support the medium. The energy absorbing medium includes a flowable material disposed on the upper surface of the support frame substantially on the linear trajectory. The flowable material includes a plurality of sheets of substantially rectangular material arranged in random orientations relative to the path of the bullet. Each of the sheets is configured for deflecting the associated bullet from its substantially linear path and absorbing energy from the associated bullet by the deflecting, thereby slowing the traveling of the associated bullet through the flowable material. Each sheet is also configured to be pierced by the bullet, thereby also slowing the traveling of the associated bullet through the flowable material. Each of the plurality of sheets of substantially rectangular material includes, in one embodiment, a rubber material and one or more sheets of fabric material formed of meshed strands coupled with the rubber material. In one preferred form, the one or more sheets of fabric material are laminated with the rubber material. However, other forms of attaching or otherwise coupling the fabric with the rubber, such as by impregnation methods for example or others can be used.

The foregoing bullet trap system and method provides for the stopping of bullets and for the containment of the bullets for later collection and/or disposal and addresses the above referred problems, and others, and provides systems and methods advantageously used to assist in providing a safe and environmental friendly target practice system.

Still other advantages, aspects and features of the present methods and apparatus will become readily apparent to those skilled in the art from the following description wherein there are shown and described example embodiments, simply by way of illustration of one of the best modes best suited for to carry out the example embodiments. As it will be realized, the embodiments are capable of other different embodiments and its several details are capable of modifications in various obvious aspects all without departing from the scope of this disclosure. Accordingly, the drawings and descriptions will be regarded as illustrative in nature and not as restrictive

BRIEF DESCRIPTION OF THE DRAWINGS

The embodiments may take physical form in certain parts and steps and arrangements of parts and steps, the example embodiments of which will be described in detail in the specification and illustrated in the accompanying drawings hereof and wherein.

DETAILED DESCRIPTION OF THE EXAMPLE EMBODIMENTS

Figure 1:
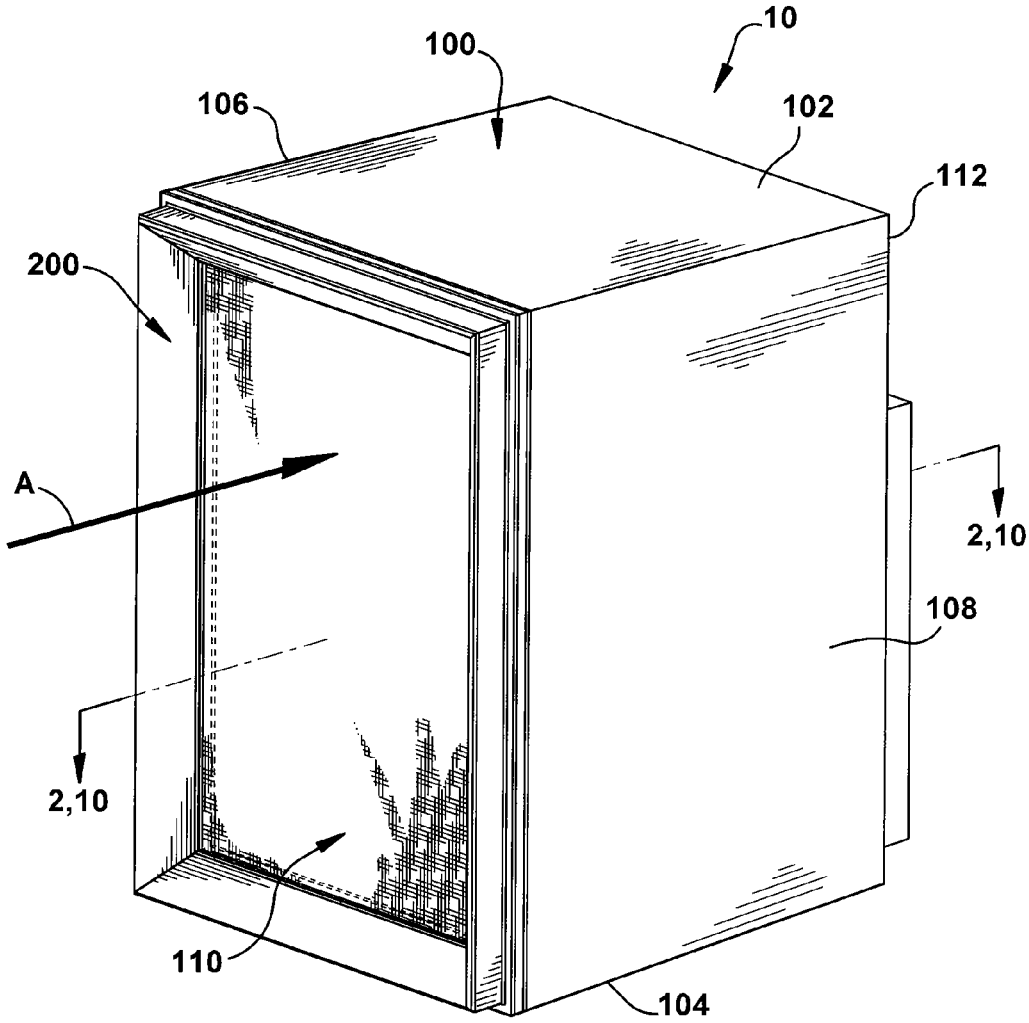
FIG. 1 is perspective view of a bullet trap apparatus according to a first example embodiment.

With reference now to the drawings wherein the showings are for purposes of illustrating the example embodiments only and not for purposes of limiting same, FIG. 1 provides an overall view of a bullet trap apparatus 10 in accordance with a first example embodiment. The apparatus 10 in the example embodiment is formed in part by a generally cube-shaped outer housing 100 having top 102 and bottom 104 sides, opposite left 106 and right 108 sides, a front side 110 configured to be oriented in general toward a user of the bullet trap apparatus 10 such as, for example, oriented towards a shooter for target practice, and a rear side 112. The front side may be configured to carry or otherwise present a target to the user of the apparatus 10. In one preferred form, the top, bottom, left, right, and rear sides 102, 104, 106, 108, and 112 are formed of a steel material having a generally rectangular shape and a desired thickness such as, for example, ⅛ inch thick steel panel material. The front side 110 is in one embodiment formed of ⅛ inch thick rubber material and has a generally rectangular opening for permitting the bullet to pass therethrough in a manner to be described below. The housing 100 may have any desired configuration such as, for example, the general form of a standard metal parts shipping box, which may have rough outer dimensions such as 32 inches high (top 102 to bottom 104), 20 inches wide (left 106 to right 108), and 16 inches deep (front 110 to back 112). Another larger housing may have rough outer dimensions such as 38 inches high (top 102 to bottom 104), 24 inches wide (left 106 to right 108), and 24 inches deep (front 110 to back 112). It has been found that conversion of otherwise standard metal parts shipping boxes into the bullet trap apparatus of the example embodiments is particularly easy and efficient. Of course, the subject bullet trap apparatus can be fabricated from other preexisting boxes or constructed from new material and may have any shape or size as necessary so that the desired characteristics are obtained.

Figure 2:
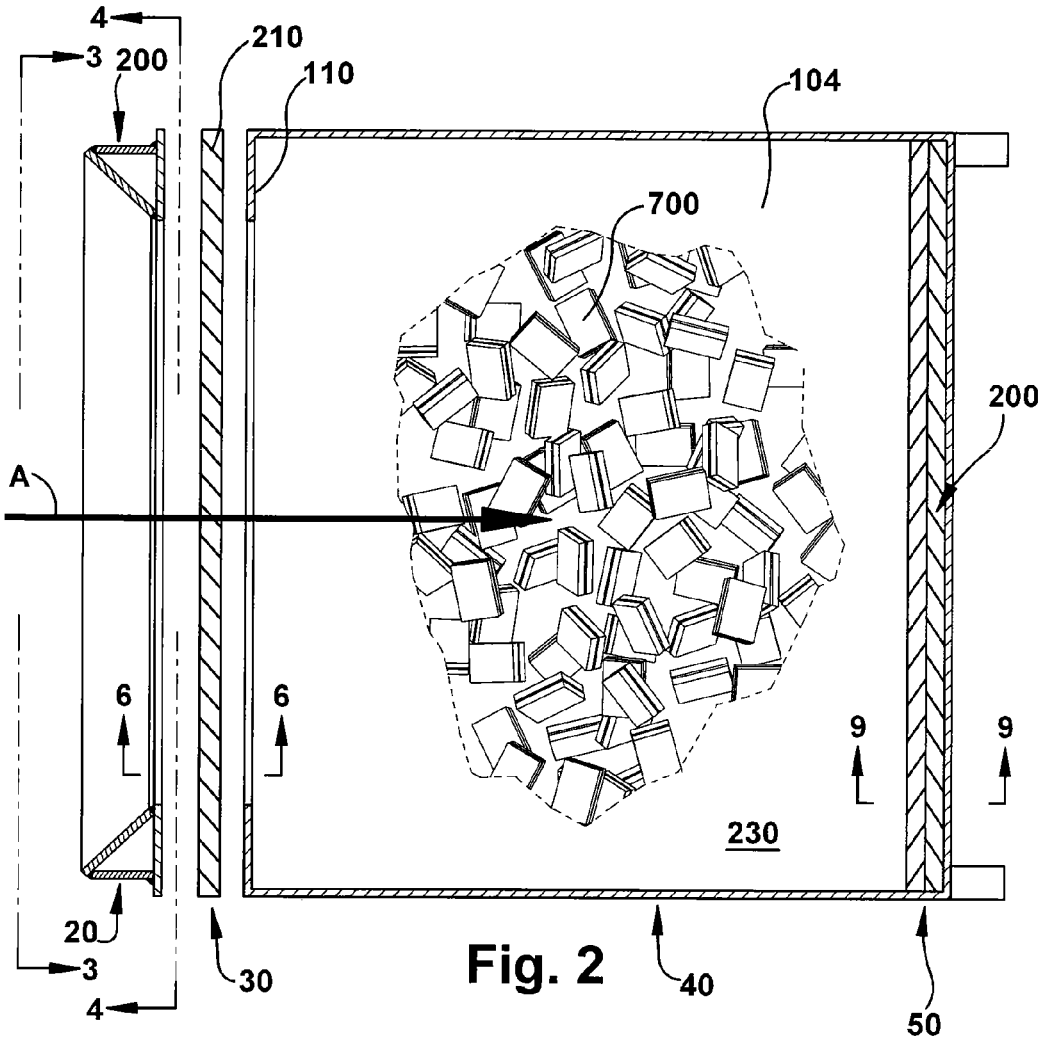
FIG. 2 is a cross-sectional top view of the bullet trap apparatus of the first embodiment, taken along line 2-2 of FIG. 1.
Figure 3:
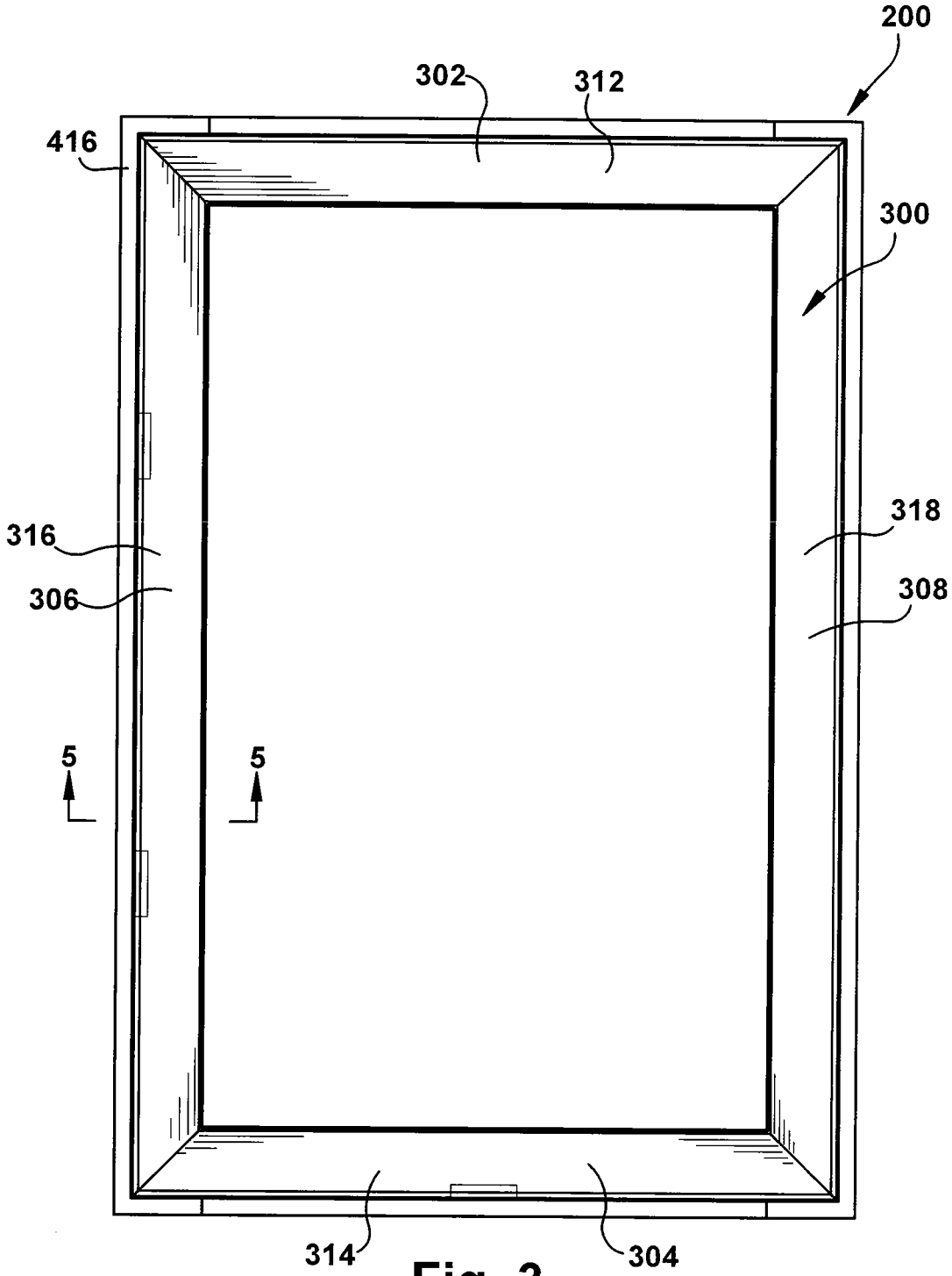
FIG. 3 is a front elevational view of a collar portion of the bullet trap apparatus of the first embodiment, taken along line 3-3 of FIG. 2.

With continued reference to FIG. 1 and with additional reference to FIG. 2, the subject example bullet trap 10 includes in general, a bullet guiding region 20, a first bullet decelerating region 30, a second bullet decelerating region 40, and a rear material containing region 50. It is to be understood that during use an associated projectile such as a bullet enters into the bullet trap apparatus 10 from left to right as viewed in FIGS. 1 and 2 along a substantially linear trajectory A. Accordingly, the bullet first encounters the guiding region 20 whereat its linear trajectory can be adjusted, as may be necessary or desired, by a collar member 200 disposed thereat and described in greater detail below. Next the associated bullet encounters the first bullet decelerating region 30, whereat a first portion of the energy of the moving bullet is absorbed by a first wall member 210. Thereafter, the associated bullet encounters the second bullet decelerating region 40 whereat the remaining energy (second portion of energy) is absorbed by active energy absorbing material 700 filling the housing and shown in FIG. 2 as a cloud for ease of illustration and discussion. In the example embodiment, the active energy absorbing material 700 is formed of individual sheets of material arranged in a random "fill" and further being movable or flowable in active response to a bullet or other projectiles traveling therethrough. Examples of the active energy absorbing material 700 will be described in greater detail below. Lastly, in the example embodiment of FIGS. 1-9, the rear material containing region 50 includes the rear wall member 220 having a construction configured to hold the energy absorbing material within the housing 100 and to arrest the travel of the associated bullet if necessary or desired to prevent it from exiting from the rear wall 112 of the housing during use of the apparatus. In one form, the rear wall member 220 is sheets of rubberized material, in another form the rear wall member 220 is sheets of rubberized material coupled with steel wall portions, and in yet another form the rear wall member 220 is sheets of rubberized material coupled with thick steel wall portions of one inch to one and a half inch thick panels. In this way, bullets are brought to a rest and are collected within the apparatus. In that regard, a suitable trough (not shown) or other collection mechanism or the like may be provided in the bottom wall 104 to enable the collection of bullets from the housing. That is, the bottom wall 104 may have an overall pyramidal shape to direct the spent bullets towards a lower collection hole by movement of the bullets under the force of gravity.

An example of the collar member 200 of the bullet guiding region 20 is shown in FIGS. 1-5 whereat, as can be seen, the collar member 200 has a size and shape roughly corresponding to the size and shape of the outer perimeter of the front wall member 110 of the housing 100. In general, the collar member 200 has an overall rectangular shape as best shown from the front view of FIG. 3 and the rear view of FIG. 4 and extends along a perimeter of the front face 110 of the housing and first wall member 210. In that way, the collar member 200 surrounds the first wall member 210 and thereby directs errant bullets which would otherwise travel past the front 110 of the housing inwardly towards the first wall member 210. For that purpose, the collar member 200 defines a bullet reflecting surface 300 (FIG. 3) essentially framing the front wall 110, the surface 300 including an upper bullet reflecting surface 302 for reflecting an errant bullet downwardly as viewed in FIG. 3, a lower bullet reflecting surface 304 for reflecting an errant bullet upwardly, a left bullet reflecting surface 306 for reflecting an errant bullet to the right, and a right bullet reflecting surface 308 for reflecting an errant bullet to the left.

Figure 4:
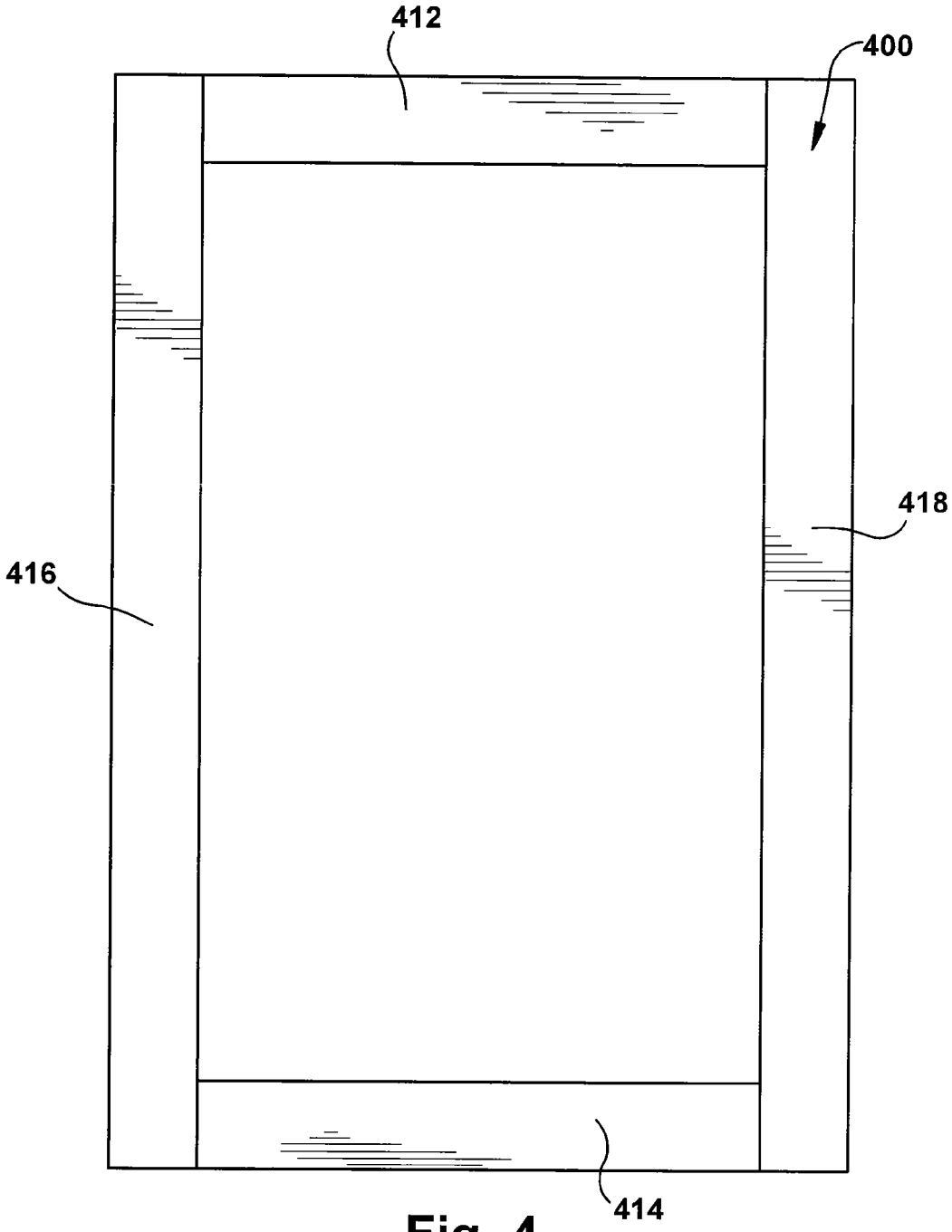
FIG. 4 is a rear elevational view of the collar portion, taken along line 4-4 of FIG. 2.
Figure 5:
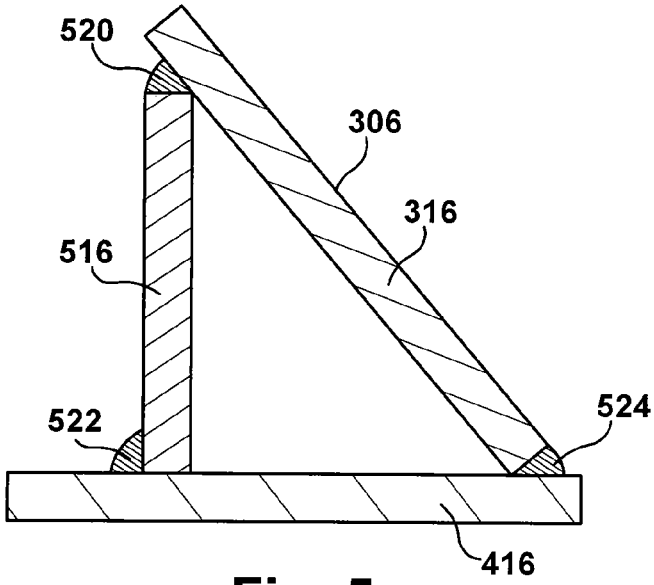
FIG. 5 is a cross sectional view of the collar portion, taken along line 5-5 of FIG. 3.

The upper, lower, left, and right bullet reflecting surfaces 302, 304, 306, 308 are each respectively defined by corresponding upper, lower, left, and right plate members 312, 314, 316, and 318 held at predetermined angles relative to the plane defined by the first wall member 210 and by the front wall member 110 of the housing. In particular, as shown in FIG. 5 for example, the left plate member 316 is held at the predetermined angle by a left bracket member 516 and a left base mounting member 416 as shown in FIG. 4. The left plate member 316, the left bracket member 516, and the left base mounting member 416 are connected or otherwise joined by any suitable manner including weld joints 520, 522, and 524 for example such as shown. Similarly, the top plate member 312 is held at the predetermined angle by a top bracket member (not shown) similar to the left bracket member and a top base mounting member 412. Also, the right plate member 318 is held at the predetermined angle by a right bracket member (not shown) similar to the left bracket member and a right base mounting member 418. Lastly, the bottom plate member 314 is held at the predetermined angle by a bottom bracket member (not shown) similar to the left bracket member and a bottom base mounting member 414.

In the example embodiment, all of the angles of the bullet reflecting plates relative to the front wall member 110 of the housing 110 are selected to be the same although it is to be appreciated that the angles may be separately selected for each of the plates and, further may be selected to be different for one or more of the plates. In the example embodiment, however, the angle of all of the plates is about 50°. A range of angles of about 50°-60° has been found to provide advantageous results as well.

Figure 6:
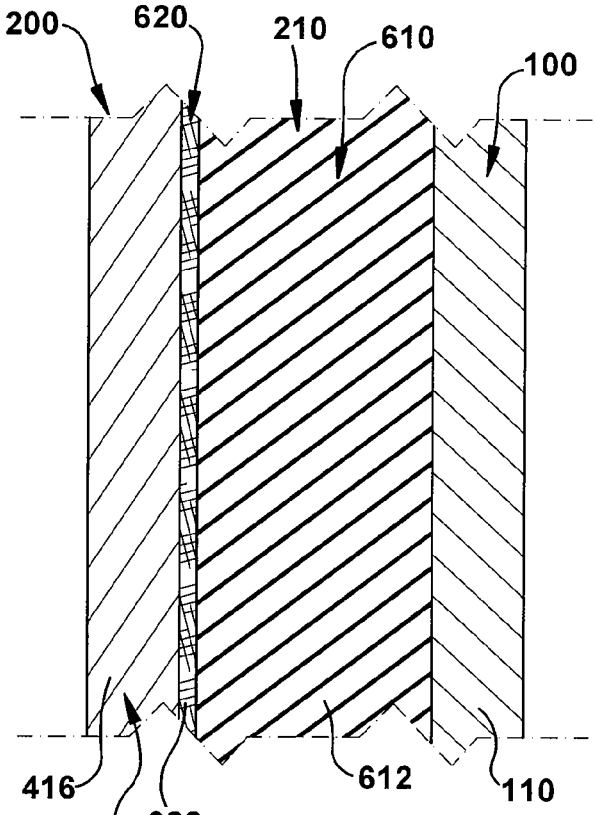
FIG. 6 is a cross sectional view of the collar portion, front wall portion, and outer housing taken along line 6-6 of FIG. 2.

While passing through the bullet guiding region 20, the projectile (bullet) may be deflected or otherwise channeled by the collar member 200 into the first bullet decelerating region 30, or the projectile if accurately aimed may directly enter into the region 30. With reference to FIGS. 2 and 6, the first bullet decelerating region 30 includes a first wall member 210 formed in the example embodiment of a first thick layer 610 of a rubberized material 612 and a second thin layer 620 of a woven or mesh material 622. The first wall member 210 has an overall thickness of about ¾ inch and is configured to cover the entire area of the opening within the collar 200. Preferably, the woven or mesh material 622 is a sheet of polyester and nylon blended woven fabric which is bonded with the rubberized material. However, other types or forms of woven or mesh material having the desired properties can be used as well for bonding with the rubberized material including for example steel mesh woven fabric. It has been found that the combination of the woven or mesh material 622 with the rubberized material results in a very dense and sticky substance for absorbing the energy of the bullet, thus slowing its speed before entering into the second bullet decelerating region 40. The polyester and nylon blended woven fabric also helps to hold the rubberized material together as a sheet during repeated use of the apparatus 10 over long periods of time without the need to frequently replace the wall member 200. Although the mesh material is illustrated as being on one side of the sheet it is to be appreciated that the mesh may be surrounded on both sides by the rubber material 612 such as in a manner to be described below in connection with the piece of energy absorbing flowable material.

In addition, the first wall member 210 provides for vibration isolation and dampening of vibrations arising in the collar member 200 in an event that the collar member is struck by a projectile. As shown in cross section in FIG. 6, the rubberized first wall member 210 is interposed between the left base mounting member 416 and the front wall member 110 of the housing 100. In that way, the collar member 400 may be permitted to resonate or otherwise vibrate when struck wherein the first wall member may help to absorb the vibratory energy. In addition, since the first wall member 110 is formed of a rubberized material, vibrations and other similar movement of the collar member is absorbed by the member 210 and not transferred to the front wall member 110 of the housing 100. In its preferred form, the collar member 200 is coupled together with the first wall member 210 to the front wall member 110 using suitable fasteners such as bolts or the like although a glue may be used as well.

With continued reference to FIGS. 1 and 2, the second bullet decelerating region 40 comprises a flowable energy absorbing material 700 disposed on an upper surface 230 of the bottom wall 104 of the housing 100. The bottom wall 104 forms a support frame configured to support the flowable material 700 during use of the apparatus and, as noted above, may be formed to provide a bullet collection trough or the like. In an example embodiment, a sufficient amount of the flowable material 700 is added into the inner area defined by the housing to fill the housing wherein the left, right, front, and rear walls 106, 108, 110, and 112 are recruited to provide support for containing the flowable material within the housing.

One example embodiment of filling the housing 100 of the apparatus 10 with the flowable material 700 includes initially filling the housing with a first amount of the flowable material 700 and thereafter shaking the housing to enable the first amount of material to settle and mesh into a tight pack having a high percentage fill factor. Then a second amount of the flowable material 700 is added and thereafter shaken again to once again allow the material to settle. These steps may be repeated several times or as necessary to achieve a desired packing factor or compactness of the material 700. Also, the orientation of the material is randomized through use of the filling method.

Figure 7:
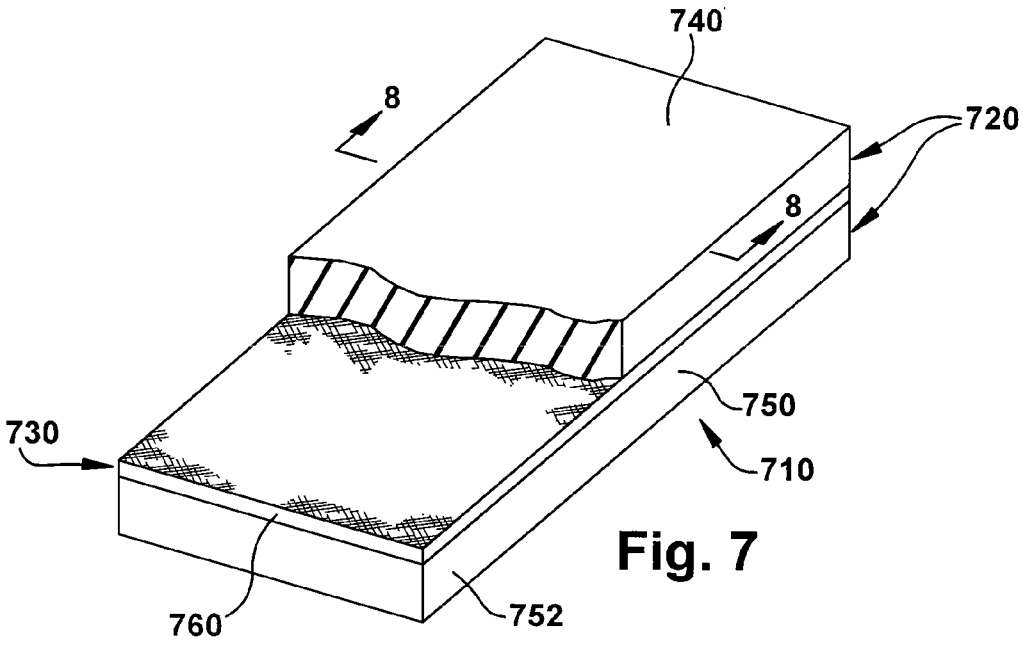
FIG. 7 is a perspective view in partial cut away of a representative sheet of material of the flowable material used in the apparatus of FIG. 1.
Figure 8:
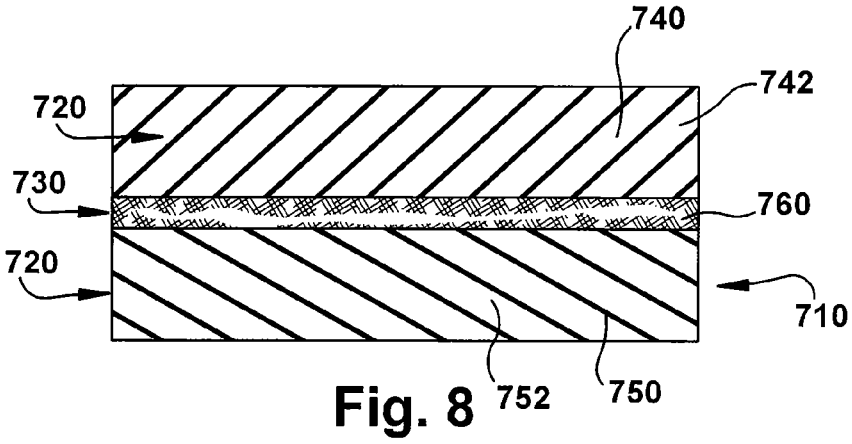
FIG. 8 is a cross-sectional view of the sheet of material taken along line 8-8 of FIG. 7.
Figure 9:
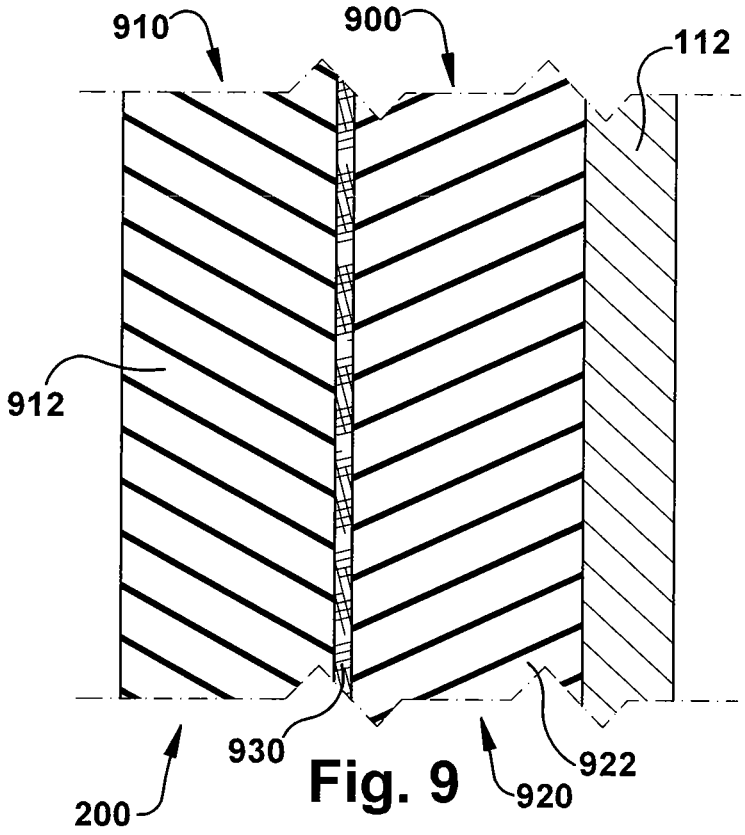
FIG. 9 is a cross sectional view of the rear wall portion, taken along line 9-9 of FIG. 2.

In the example embodiment, the flowable material 700 includes a plurality of sheets 710 of substantially rectangular material such as shown for example in FIGS. 7 and 8. Each of the sheets 710 is configured for both absorbing and deflecting the associated bullet from its substantially linear path A and absorbing energy from the associated bullet by the deflecting, thereby slowing the traveling of the associated bullet through the flowable material 700. One advantageous result of the randomized orientations of the sheets 710 is that the bullets may pass directly through sheets disposed at right angles or at near right angles to the path A, while bullets may be deflected by sheets disposed at oblique angles relative to the path A. Further, some sheets may be disposed at angles for a bullet to both pierce the sheet as well as to be deflected from the sheet. In all of these cases, energy from the bullet is absorbed by the sheets having the effect of reducing the velocity of the bullet to a negligible speed and minimal energy. In general, each of the plurality of sheets 710 of substantially rectangular material includes a rubber material 720 and a stranded fabric 730 disposed in the rubber material 720. In one preferred form, the stranded fabric 730 is a woven sheet of fabric 730.

In one form, each of the plurality of sheets 710 of substantially rectangular material includes a first rectangular portion 740 formed of a first rubber material 742 having a first hardness, a second rectangular portion 750 formed of a second rubber 752 material having a second hardness less than the first hardness, and a stranded fabric 760 disposed between the first 740 and second 750 rectangular portions. In one preferred form, the stranded fabric 760 is a woven sheet of fabric 760. In another embodiment, each of the plurality of sheets 710 of substantially rectangular material includes a first rectangular portion 740 formed of a first rubber material 742 having a first hardness, a second rectangular portion 750 formed of a second rubber 752 material having a second hardness greater than the first hardness, and a stranded or woven fabric 760 disposed between the first 740 and second 750 rectangular portions. In yet a further embodiment, each of the plurality of sheets 710 of substantially rectangular material includes a first rectangular portion 740 formed of a first rubber material 742 having a first hardness, a second rectangular portion 750 formed of a second rubber 752 material having a second hardness substantially the same as the first hardness, and a stranded or woven fabric 760 disposed between the first 740 and second 750 rectangular portions. The characteristics of the first and second rubber materials may be selected as desired. However, in the example embodiment, the first rubber material 742 has a first Shore A hardness of about 65 D (±5D) and the second rubber material 752 has a second Shore A hardness of about 65 D (±5D). Further in the example embodiment, the stranded fabric 760 is a woven blend of polyester fabric with nylon fabric. With regard to the size of the sheets, in the example, the plurality of sheets of substantially rectangular material have a size within a range of about 1"×3" to 2"×4". Also, the pieces range in thickness from a size of about ½ inch to about ⅞ inch. Although in the example embodiment described only a single woven sheet is illustrated, it is to be appreciated that other embodiments include multiple layers of woven and/or stranded sheets.

As noted above, the rubber on opposite sides of the rectangular pieces may have the same or different hardness values wherein in one embodiment, one of the rubber sides is a form of soft sticky rubber and the other side is of a hard smooth rubber. In any case, the pieces are poured into the housing and compressed and/or shaken in one or more compression and/or shaking steps to create an interlocked medium with varying surface textures which are randomized throughout the housing. During use of the apparatus, each piece of rubber sheet 710 is somewhat free to move and react to a bullet strike thereby absorbing the energy from the bullet slowing it down and preferably containing it within the mass of flowable medium within the housing. The energy may be converted to heat, transferred to adjacent sheets by mechanical interaction, or both converted and transferred. Essentially, because these collisions are inelastic, a large and very efficient energy transfer takes place to bring the bullet to a halt within the enclosure. Because of the many different angles created by the randomization of the pieces 710 in the housing, a bullet hitting into the medium and passing through individual pieces is redirected in many different directions, each angled hit causing the bullet to slow. In that way, in the example embodiments, bullet deceleration is swift. Also, because the pieces 710 are arranged at many different angles, wound channels which might result if the pieces were arranged into a uniform pattern are discouraged or otherwise minimized. Still further, for small channels that are created by bullets passing through the pieces, those small channels are closed by the weight of the rubber pieces piled above the small channel. The channels which may be created are essentially filled as they form. Yet still further, the woven material in the pieces is advantageous as it holds the remaining portions of partially deteriorated pieces together.

Although it is rare, nevertheless, bullets may pass through the second decelerating region 40 and impact the rear material containing region 50. In that regard, although such projectiles usually have very little energy left, the rear material containing region 50 includes a ballistic rubber sheet 900 held against the rear wall 112 of the enclosure as shown in top view in FIG. 2 and in cross sectional view in FIG. 9. The ballistic rubber sheet 900 is formed similarly to the rectangular pieces 710. In the example embodiment, the sheet 900 is substantially rectangular and includes a first rectangular portion 910 formed of a first rubber material 912 having a first hardness, a second rectangular portion 920 formed of a second rubber 922 material having a second hardness less than the first hardness, and a stranded fabric 930 disposed between the first 910 and second 920 rectangular portions. In one preferred form, the stranded fabric 930 is a woven sheet of fabric 930. The characteristics of the first and second rubber materials may be selected as desired. However, in the example embodiment, the first rubber material 912 has a first Shore A hardness of about 65 D (+5D) and the second rubber material 922 has a second Shore A hardness of about 65 D (+5D). Further in the example embodiment, the woven fabric 930 is a woven blend of polyester fabric with nylon fabric. However, other types or forms of woven or mesh material having the desired properties can be used as well for bonding with the rubberized material including for example steel mesh woven fabric. With regard to the size of the sheets, in the example, the plurality of sheets of substantially rectangular material have a size within a range of about 20"×32" to 24"×38". Also, the pieces range in thickness from a size of about ½ inch to about ⅞ inch. The sheet 900 is provided to absorb the final amount of energy remaining in the bullet, if any, so as to contain the bullet within the housing for later retrieval and/or collection. In a further embodiment, the sheet 900 may simply be formed of a 1 inch to 1.5 inch thick steel wall or plate member or of any other material having the desired characteristics of preventing bullets from passing through the rear wall portion of the apparatus.

Figure 10:
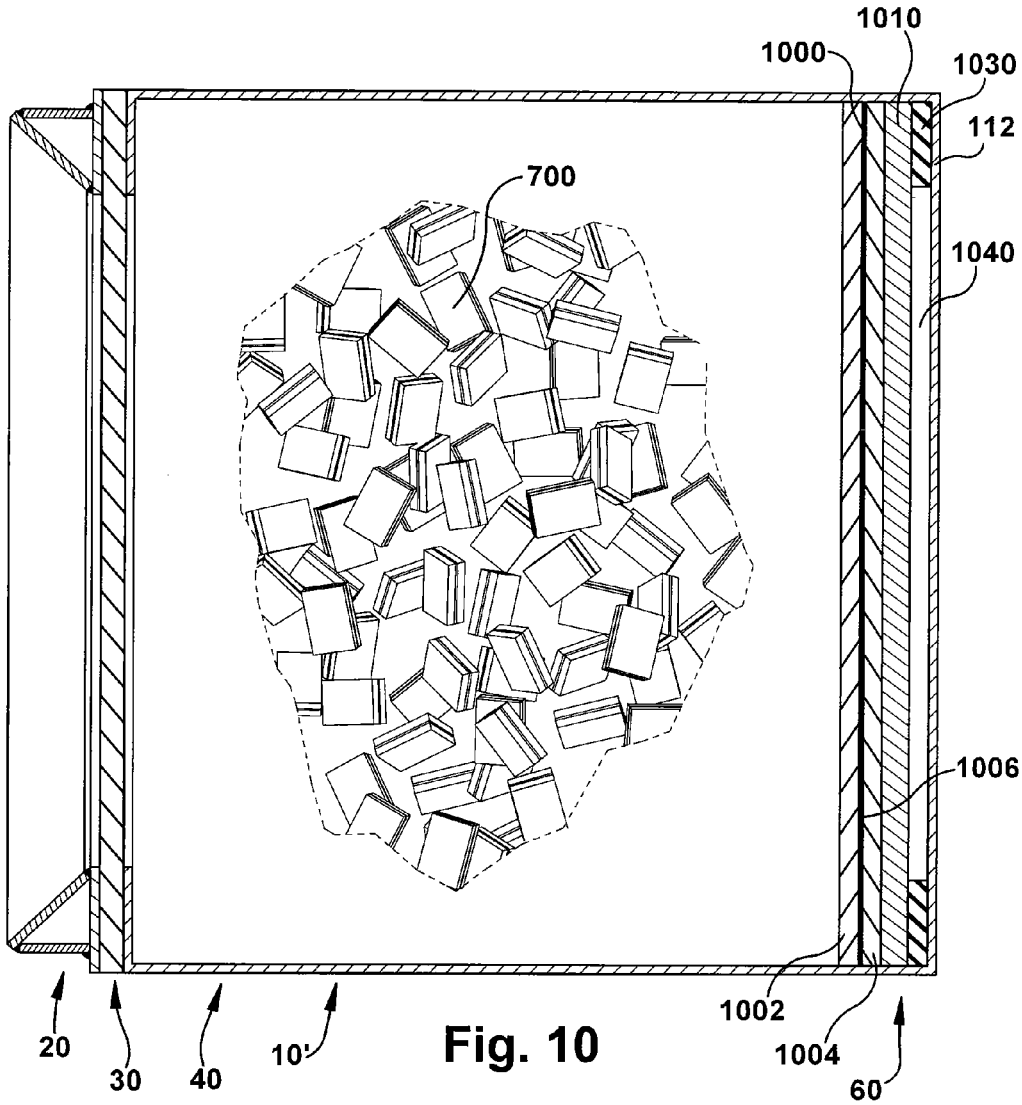
FIG. 10 is a cross-sectional top view of a bullet trap apparatus according to a second example embodiment taken along line 10-10 of the first example embodiment of FIG. 1 for illustration purposes.

FIG. 10 illustrates a further example embodiment of a bullet trap apparatus 10' including a bullet guiding region 20 similar to the bullet guiding region of the example embodiment described above, a first bullet decelerating region 30 similar to the first bullet decelerating region of the example embodiment described above, a second bullet decelerating region 40 similar to the second bullet decelerating region of the example embodiment described above, and a ballistic barrier member 60 to be described below.

The ballistic barrier member 60 includes a ballistic rubber sheet 1000 held against a resonating member 1010 which is mounted to the rear wall 112 of the enclosure using a peripheral rubber spacer member 1030. The ballistic rubber sheet 1000 is formed similarly to the sheet 900 described above and also to the rectangular pieces 710. In the example embodiment, the sheet 1000 is substantially rectangular and includes a first rectangular portion 1002 formed of a first rubber material having a first hardness, a second rectangular portion 1004 formed of a second rubber material having a second hardness less than the first hardness, and a stranded fabric 1006 disposed between the first 1002 and second 1004 rectangular portions. In one preferred form, the stranded fabric is a woven sheet of fabric 1006. The characteristics of the first and second rubber materials may be selected as desired. However, in the example embodiment, the first rubber material has a first Shore A hardness of about 65 D (±5D) and the second rubber material has a second hardness of about 65 D (±5D). Further in the example embodiment, the woven fabric 1006 is a woven and/or stranded blend of polyester fabric with nylon fabric. However, other types or forms of woven or mesh material having the desired properties can be used as well for bonding with the rubberized material including for example steel mesh woven fabric. With regard to the size of the sheets, in the example, the plurality of sheets of substantially rectangular material have a size within a range of about 20"×32" to 24"×38". Also, the pieces range in thickness from a size of about ½ inch to about ⅞ inch.

The sheet 1000 is provided to absorb the final amount of energy remaining in the bullet, if any, so as to contain the bullet within the housing for later retrieval and/or collection. In that regard, the sheet is carried on the resonating member 1010 which is configured to flex like the skin of a drum when impacted laterally as viewed in the Figure. The flexing is in part enabled by the gap 1040 formed between the member 1010 and the rear wall 112 by the rubber spacer members 1030 which in the example embodiment extends around the periphery of the rear wall and the member 1010. The selection of the thicknesses of the sheet 1000 and the member 1010 together with a selection of the characteristics thereof enables users to tune the system to best absorb the anticipated energy from bullets which may pass through the flowable medium 700. In one example embodiment, the sheet 1000 may be a 1 inch to 1.5 inch thick metal panel or any other material having the desired characteristics of preventing bullets from passing through the rear wall of the apparatus.

As described hereinabove, the present embodiments solve many problems associated with previous bullet trap type devices. However, it will be appreciated that various changes in the details, materials, and arrangements of parts, which have been herein described and illustrated in order to explain the nature of the embodiments, may be used by those skilled in the art without departing form the principle and scope of the inventions as expressed in the appended claims.

Having thus described the example embodiments, it is now claimed:

1. A bullet trap apparatus for capturing an associated bullet traveling along a substantially linear trajectory, the bullet trap apparatus comprising:

a support frame having an upper surface configured to support associated material;

a flowable material disposed in a randomized orientation on the upper surface of the support frame substantially on the linear trajectory, the flowable material including a plurality of sheets of substantially flat rectangular material, each of the sheets being configured to move freely relative to the upper surface of the support frame for absorbing the associated bullet by the associated bullet penetrating the sheet and deflecting the associated bullet from its substantially linear path and each of the sheets being configured for absorbing energy from the associated bullet by the penetrating and deflecting, thereby slowing the traveling of the associated bullet through the flowable material; and, a housing operatively coupled with the support frame and having opposite front and back walls spaced apart along the linear trajectory of the associated bullet, the housing and the front and back walls being configured to contain the flowable material;

wherein the back wall of the housing includes an energy absorbing sheet of rubberized material having a stranded fabric therein and being disposed along the trajectory to absorb energy from the associated bullet after the bullet exits from the flowable material;

wherein the back wall of the housing includes:

a block member;

an outer rear wall member defining a back portion of the bullet trap apparatus on a side thereof opposite the front wall; and, an inner rear wall member adjacent to the energy absorbing sheet of rubberized material and spaced apart from the outer rear wall member by the block member to define a space therebetween, wherein portions of the inner rear wall member spaced from the block member are free to vibrate in the space without contacting the outer rear wall member.

2. The bullet trap apparatus according to claim 1 wherein each of the plurality of sheets of substantially rectangular material comprises:

a rubber material; and, a stranded fabric disposed in the rubber material.

3. The bullet trap apparatus according to claim 2 wherein the stranded fabric is impregnated within the rubber material of each of the plurality of sheets.

4. The bullet trap apparatus according to claim 1 wherein each of the plurality of sheets of substantially rectangular material comprises:

a first rectangular portion formed of a first rubber material having a first hardness;

a second rectangular portion formed of a second rubber material having a second hardness; and, a stranded fabric disposed between the first and second rectangular portions.

5. The bullet trap apparatus according to claim 4 wherein the first hardness of the first rubber material is less than the second hardness of the second rubber material.

6. The bullet trap apparatus according to claim 4 wherein:

the first rubber material has a first Shore A hardness of about 65 D;

the second rubber material has a second Shore A hardness of about 65 D; and, the stranded fabric is a woven sheet of a blend of polyester fabric with nylon fabric.

7. The bullet trap apparatus according to claim 4 wherein:

the plurality of sheets of substantially rectangular material have a size within a range of about 1"×3" to 2"×4".

8. The bullet trap apparatus according to claim 1, further comprising:

a collar member disposed along a perimeter of the front wall, the collar member extending forwardly and outwardly of the front wall and having a forwardly directed inclined surface configured to deflect the associated bullet from an errant trajectory directed at the collar member to a corrected trajectory directed at the front wall.

9. The bullet trap apparatus according to claim 8, wherein:

the collar member is disposed along an entirety of the perimeter of the front wall to form a continuous forwardly directed inclined surface.

10. The bullet trap apparatus according to claim 9, wherein the continuous forwardly directed inclined surface is held at an angle of about 50°-60° relative to a plane defined by the front wall.

11. The bullet trap apparatus according to claim 1, wherein the front wall of the housing comprises a second energy absorbing sheet of rubberized material having a stranded fabric therein and being disposed along the trajectory on a first side of the flowable material to absorb energy from the associated bullet before the bullet reaches the flowable material.

12. The bullet trap apparatus according to claim 1, wherein:

the inner and outer rear wall members are substantially rectangular; and, the block member is disposed along a perimeter of the substantially rectangular inner and outer rear wall members.

13. The bullet trap apparatus according to claim 12, wherein:

the block member is formed of a rubber material.

14. A bullet trap apparatus for capturing an associated bullet traveling along a substantially linear trajectory, the bullet trap apparatus comprising:

a support frame having an upper surface configured to support associated material;

a flowable material disposed on the upper surface of the support frame substantially on the linear trajectory, the flowable material comprising a plurality of sheets of substantially rectangular material, each of the sheets being configured for absorbing the associated bullet by the associated bullet penetrating the sheet and deflecting the associated bullet from its substantially linear path and each of the sheets being configured for absorbing energy from the associated bullet by the penetrating and deflecting, thereby slowing the traveling of the associated bullet through the flowable material; and, a housing operatively coupled with the support frame and having opposite front and back walls spaced apart along the linear trajectory of the associated bullet, the housing and the front and back walls being configured to contain the flowable material;

wherein the front wall of the housing comprises a first energy absorbing sheet of rubberized material having a stranded fabric therein and being disposed along the trajectory on a first side of the flowable material to absorb energy from the associated bullet before the bullet reaches the flowable material; and, wherein the back wall of the housing comprises a second energy absorbing sheet of rubberized material having a stranded fabric therein and being disposed along the trajectory on a second side of the flowable material opposite the first side to absorb energy from the associated bullet after the bullet exits from the flowable material; a block member; an outer rear wall member defining a back portion of the bullet trap apparatus on a side thereof opposite the front wall; and an inner rear wall member in contact with the second energy absorbing sheet of rubberized material and spaced apart from the outer rear wall member by the block member to define a space therebetween, wherein portions of the inner rear wall member spaced from the block member are free to vibrate in the space without contacting the outer rear wall member.

15. The bullet trap apparatus according to claim 14, wherein:

the inner and outer rear wall members are substantially rectangular; and, the block member is disposed along a perimeter of the substantially rectangular inner and outer rear wall members.

16. The bullet trap apparatus according to claim 15, wherein:

the block member is formed of a rubber material.

* * * * *